United States Patent [19]

Garofalo

[11] 4,087,865

[45] May 9, 1978

[54] DIVING MASK

[75] Inventor: Giovanni Garofalo, Rapallo, Italy

[73] Assignee: AMF Incorporated, White Plains, N.Y.

[21] Appl. No.: 731,232

[22] Filed: Oct. 12, 1976

[51] Int. Cl.[2] ..... A61F 9/02

[52] U.S. Cl. ..... 2/428

[58] Field of Search ..... 2/428, 429, 430, 9, 2/439, 440; 264/328, DIG. 76; 249/107

[56] References Cited

U.S. PATENT DOCUMENTS

| | | | |
|---|---|---|---|
| 2,593,892 | 4/1952 | Kindel | 2/428 X |
| 2,799,435 | 7/1957 | Abplanalp | 264/DIG. 76 |
| 3,694,814 | 10/1972 | De Barbieri | 2/428 |

FOREIGN PATENT DOCUMENTS

| | | | |
|---|---|---|---|
| 595,192 | 11/1947 | United Kingdom | 2/428 |

*Primary Examiner*—Werner H. Schroeder
*Assistant Examiner*—Peter Nerbun
*Attorney, Agent, or Firm*—George W. Price; Walter Lewis

[57] ABSTRACT

A diving mask comprises a rigid front sight piece, transparent at least for its major portion and a flexible anatomically shaped body, which is molded in a suitable mold inside which the front piece has been arranged previously. The front piece is provided, along its whole edge portion, with a plurality of through bores, inside which bores, upon molding of said shaped body, the material forming the said body penetrates so as to realize a watertight connection of the front piece and of the body.

3 Claims, 9 Drawing Figures

DIVING MASK

SUMMARY OF THE INVENTION

It is known that diving masks substantially comprise a rigid front piece, transparent at least in its major portion, supported by a suitably shaped body of a resiliently yieldable material.

During the construction of a diving mask, the assembling of these two members constitutes a problem involving the basic characteristics of a mask, such as the structural strength and water-tightness. Said assembling is still more difficult when a mask is so shaped as to accomodate the nose of a user.

This invention proposes a diving mask wherein said front piece and said shaped body are assembled firmly and in a water tight manner.

Substantially, the invention contemplates first the construction of said front piece, with a plurality of small through-holes all around the edge thereof, and then of said shaped body, which is molded in a mold in which said front piece has been previously arranged, so that the material that is injected into the mold enters also inside said peripheral through-holes in the front piece, thus interlocking said members firmly and with perfect water-tightness.

These and other features of the invention, and the advantages resulting therefrom, will be evident from the following detailed description of some preferred embodiments thereof, made with reference to the attached drawings.

DESCRIPTION OF A FIRST PREFERRED EMBODIMENT

Figure 2:
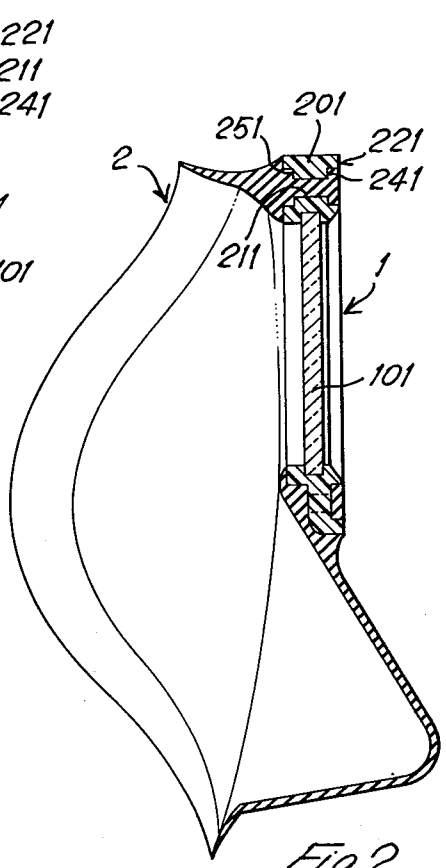
FIG. 2 is a vertical sectional view of said mask, on line II—II of FIG. 1.
Figure 1:
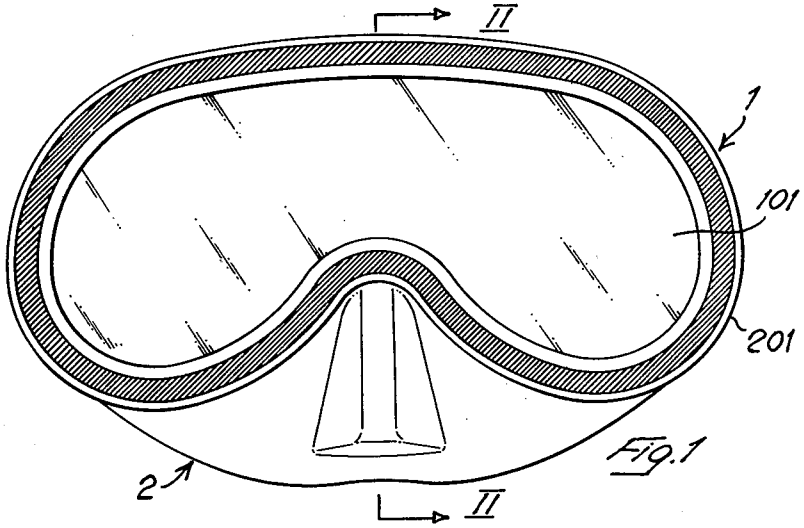
FIG. 1 is a front view of a diving mask according to a first embodiment of the invention.

FIGS. 1 and 2 show a diving mask according to the invention and having a nose-shaped portion.

Substantially, said mask comprises a front piece 1, transparent in its major portion and rigid, which is supported by an anatomically-shaped body 2 made of rubber or, preferably, of a thermoplastic synthetic resin having physical characteristics similar to those of rubber, such as for example the resin marketed under the name "Kraton".

Figure 4:
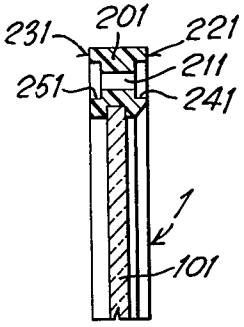
FIG. 4 is a fragmentary sectional view of said front piece on line IV—IV of FIG. 3.
Figure 3:
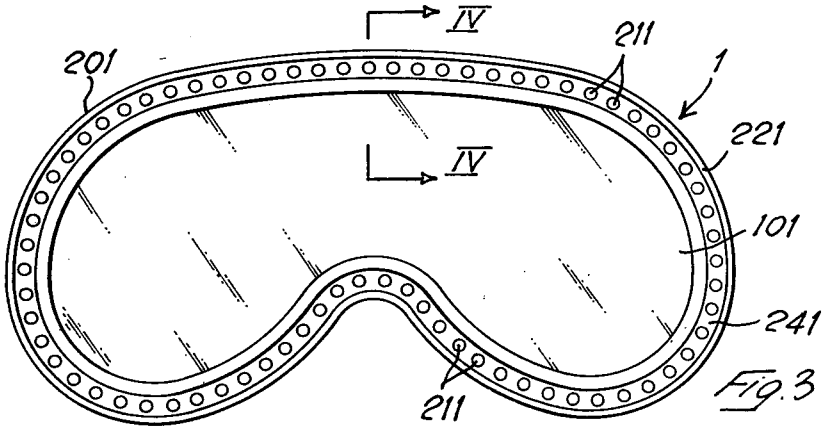
FIG. 3 is a front view of the front piece alone of said mask.

Said front piece 1 (FIGS. 3 and 4) comprises a suitably shaped glass-pane 101 that is mounted firmly and with perfect water-tightness in a frame 201 of similar shape.

According to the invention, said frame 201, made of synthetic resin, preferably of thermoplastic nature, and having sufficient rigidity, is provided with a plurality of suitably-spaced small through-bores 211 connecting its front edges 221, 231. Moreover, said front edges 221, 231 are provided with grooves 241, 251, respectively, along the line of perforation.

Upon manufacturing of the complete mask, the anatomically shaped body 2 is formed by injecting a suitable material into a mold inside which the complete front piece 1 has been arranged previously. Thus, said material can also enter inside said bores 211 and grooves 241 and 251 of said frame 201, so as to interlock the front piece 1 and the shaped body 2 with perfect water-tightness.

Still better results can be obtained by utilizing for the frame 201 and the body 2, materials having the same melting temperature so that these two members are united not only by mechanical interlock, but also by welding (at least superficially) in the contact zones.

DESCRIPTION OF A SECOND PREFERRED EMBODIMENT

Figure 5:
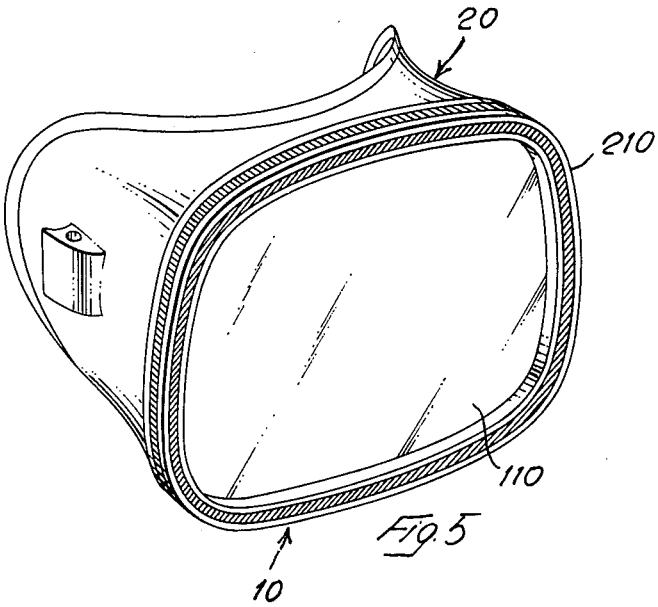
FIG. 5 is a perspective view of a second embodiment of a diving mask according to the invention.
Figure 6:
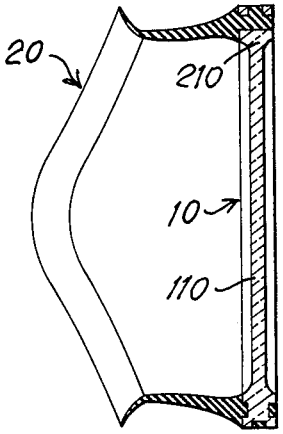
FIG. 6 is a vertical sectional view of said mask.

FIGS. 5 and 6 show a modification of the invention, wherein the diving mask is of a more common type, not provided with a nose-shaped portion.

The front piece 10 of this mask, supported by the shaped body 20, is merely formed by a transparent plate 110 of synthetic resin, preferably a thermoplastic resin, having good stiffness characteristics, such as the one marketed under the name of "Plexiglas".

Figure 7:
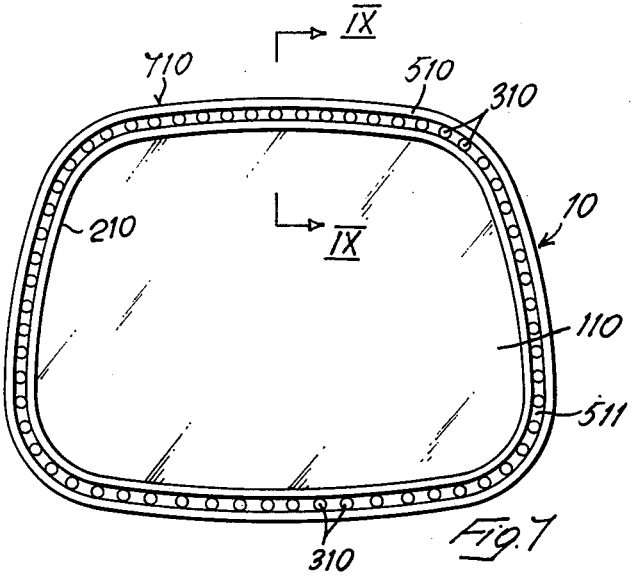
FIGS. 7 and 8 are a front view and a plan view of the front piece, respectively, of the mask shown in FIG. 5.
Figure 9:
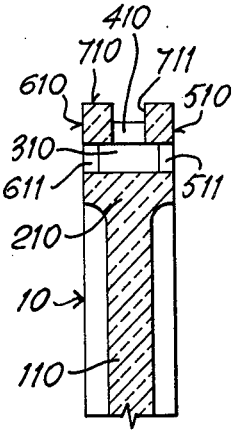
FIG. 9 is a fragmentary sectional view of the front piece of FIG. 8, on line IX—IX of FIG. 7.
Figure 8:
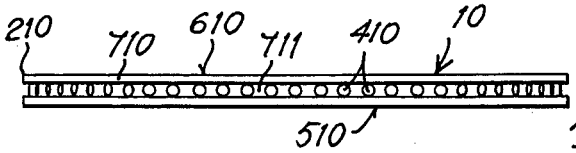

Said plate 110 (FIGS. 7 to 9) presents a thicker peripheral rim 210 along which two series of small bores 310, 410 are formed. More particularly, bores 310 are suitably spaced from one another and are made as through-bores in the front faces 510, 610 of rim 210, while bores 410 are formed along the outer side face 710 of said rim, and each of them opens into a corresponding bore 310. Moreover, grooves 511, 611 and 711 are formed respectively in the front faces 510, 610 and in the side face 710 of said rim.

The process of manufacturing of this diving mask is the same as the one described with reference to FIGS. 1 to 4.

However, in this second embodiment, the union between the front piece 10 and the shaped body 20 is stronger, inasmuch as the double series of bores ensures a substantial strengthening of the interconnection of both members.

Obviously, many variations and modifications, particularly in the construction, can be made within the scope of the invention. For example, the peripheral bores in the front piece of the mask can be of frusto-conical shape with the greater base facing outwards. All such variations fall within the basic principle of the invention as disclosed above and claimed hereafter.

I claim:

1. In a watertight face mask comprising a generally annular shaped resilient material face conforming member and a transparent sight panel member mounted in the front part of said face conforming member; an improved watertight seal structure between said two members, said improved seal structure comprising a plastic rim member surrounding the periphery of said sight panel member, said rim member having radially inner and outer and front and back circumferential extending surfaces, said rim member being thicker in its front to back dimension than the thickness of said sight panel member, said sight panel member being mounted to the radially inner circumferential surface of said rim member, a plurality of spaced holes formed in said rim member along the entire circumference thereof, said holes extending clear through said rim member through said front and back circumferential extending surfaces, a continuous circumferential extending groove formed in said front and back circumferential extending surfaces, said grooves being aligned with said holes whereby said holes open into said grooves, and integral portions of the front of said face conforming member being disposed in and filling said grooves and holes to provide a watertight seal between said rim and face conforming members.

2. In the improvement of claim 1, wherein said grooves are wider than the diameter of said holes, a continuous circumferential groove in the radially inner circumferential surface of said rim member, said panel member being watertight embedded in said last mentioned groove.

3. In the improvement of claim 1, wherein said panel member is integral with the radially inner circumferential surface of said rim member, a continuous circumferential groove formed in the radially outer circumferential surface of said rim member, and a plurality of spaced holes formed in the bottom of said last mentioned groove, said last mentioned holes opening into said first mentioned holes, and said integral portions of said face conforming member also extending into and filling said last mentioned groove and holes.

* * * * *